US006164212A

United States Patent [19]

Haggard

[11] Patent Number: 6,164,212

[45] Date of Patent: Dec. 26, 2000

[54] PAINTER'S MOBIL WORKSTATION

[76] Inventor: Virgil T Haggard, 2209 Valentine Ave., Pekin, Ill. 61554

[21] Appl. No.: 09/336,856

[22] Filed: Jun. 21, 1999

[51] Int. Cl.[7] ..... A47B 85/00

[52] U.S. Cl. ..... 108/25; 108/115

[58] Field of Search ..... 108/25, 26, 177, 108/176, 162, 115; 312/258, 262, 327, 328, 140.2, 140.3

[56] References Cited

U.S. PATENT DOCUMENTS

| | | | |
|---|---|---|---|
| 889,741 | 6/1908 | Additon | 312/262 |
| 963,769 | 7/1910 | Johnson et al. | 312/262 X |
| 2,550,959 | 5/1951 | Bowman | 312/258 X |
| 5,072,999 | 12/1991 | Trotta et al. | 312/258 X |
| 5,190,303 | 3/1993 | Schumacher et al. | 108/25 X |
| 5,954,412 | 9/1999 | Rutherford et al. | 108/162 X |

*Primary Examiner*—Jose V. Chen
*Attorney, Agent, or Firm*—Michael I. Kroll

[57] ABSTRACT

Disclosed is a device which provides an upright standing enclosure having a top member 12 having multiple receptacles 34 for receiving various articles for painting such as paint brushes 24, rollers 13 and cans 11. The enclosure 10 is equipped with wheels 14 for portability and legs 16 with which to stand on. Foldable handles 18 are also provided for grasping while moving the enclosure 10. The side walls 28, 36, 38 and 40 of the enclosure are hingedly connected 42, 43 so that the walls fold inwardly for storing or transporting the device.

6 Claims, 11 Drawing Sheets

PAINTER'S MOBIL WORKSTATION

BACKGROUND OF THE INVENTION

1. Field of the Invention

The present invention relates generally to portable workbenches and, more specifically, to a portable foldable workbench for the placement of articles used in painting and having wheels attached to the front bottom edge and legs attached to the rear bottom edge having elastomeric tips providing gripping means to the floor surface.

Located on the upper exterior surface of the leg side are hingedly attached handles normally pointing in a downward position which can be gripped and raised to an operative position. Said operative position being when the handles are pivoted until they engage the workbench exterior surface whereby the workbench can be raised off of the legs and moved by the wheel members to a predetermined location whereupon the workbench can be lowered until the leg members engage the floor surface and the handles are released to return to a pivoted nonoperative position.

In addition said top hingedly attached member has a plurality of form fitting receptacles for the placement of painting articles such as, paint can, paint brushes and angular receptacles for paint pad and roller tray. Thereby providing means for organizing and raising the paint containers and paint applicators to a more comfortable waist high position in a unitary mobile workbench. Furthermore the top hingedly attached member can be made from any suitable material which can be formed such as plastic.

2. Description of the Prior Art

Although there are numerous containers and attachments which address one or more of the needs of a painter. There does not exist a unitary device which collapses for storage, provides mobility, and holds the painting containers and applicators in recessed receptacles while painting.

Therefore a need exists for a portable workbench which can be retrieved from a storage area, unfolded and the top being hingedly attached flipped up, fitting into and resting on a recessed lip formed by and within the four sides thereby creating a rigid worksurface structure. The top worksurface further has receptacle means for the placement of painting containers and applicators which prevents movement of the painting materials, such as paint can, roller tray, trim pads and paint brushes, while the painting task is underway and upon finishing said task the workbench, being inwardly collapsible, can be folded and put away for future use.

SUMMARY OF THE PRESENT INVENTION

The present invention discloses a device which provides an upright standing enclosure having a flat top member having multiple receptacles therein for receiving various articles for painting such as paint brushes, rollers and cans. The enclosure is equipped with wheels for portability and legs with which to stand on. Foldable handles are also provided for grasping while moving the enclosure. The side walls of the enclosure are hingedly connected so that the walls fold inwardly for storing or transporting the device.

The present invention relates generally to portable workbenches and, more specifically, to a portable foldable workbench for the placement of articles used in painting and having wheels for selective placement of said workbench.

A primary object of the present invention is to provide a waist high workbench for painting containers and applicators.

Another object of the present invention is to provide a waist high workbench for painting containers and applicators which will folded to a compact width for easy storage and retrieval as needed.

A still further object of the present invention is to provide a waist high foldable workbench having wheels for selective mobility and legs for nonmovable stability.

A yet further object of the present invention is to provide a waist high workbench having hingedly attached side members for easy folding.

Another object of the present invention is to provide a waist high workbench having a hingedly attached top member with removable pins for easy cleanup. Further said member can be made from any suitable material used in forming such as plastics.

A still further object of the present invention is to provide a waist high workbench having a hingedly attached top member having form fitting receptacles for the secure placement of paint container and applicators.

A yet further object of the present invention is to provide a waist high workbench having hingedly attached handles which have a small footprint and can be pivotally extended to an operative position thereby permitting said workbench to be selectively repositioned.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
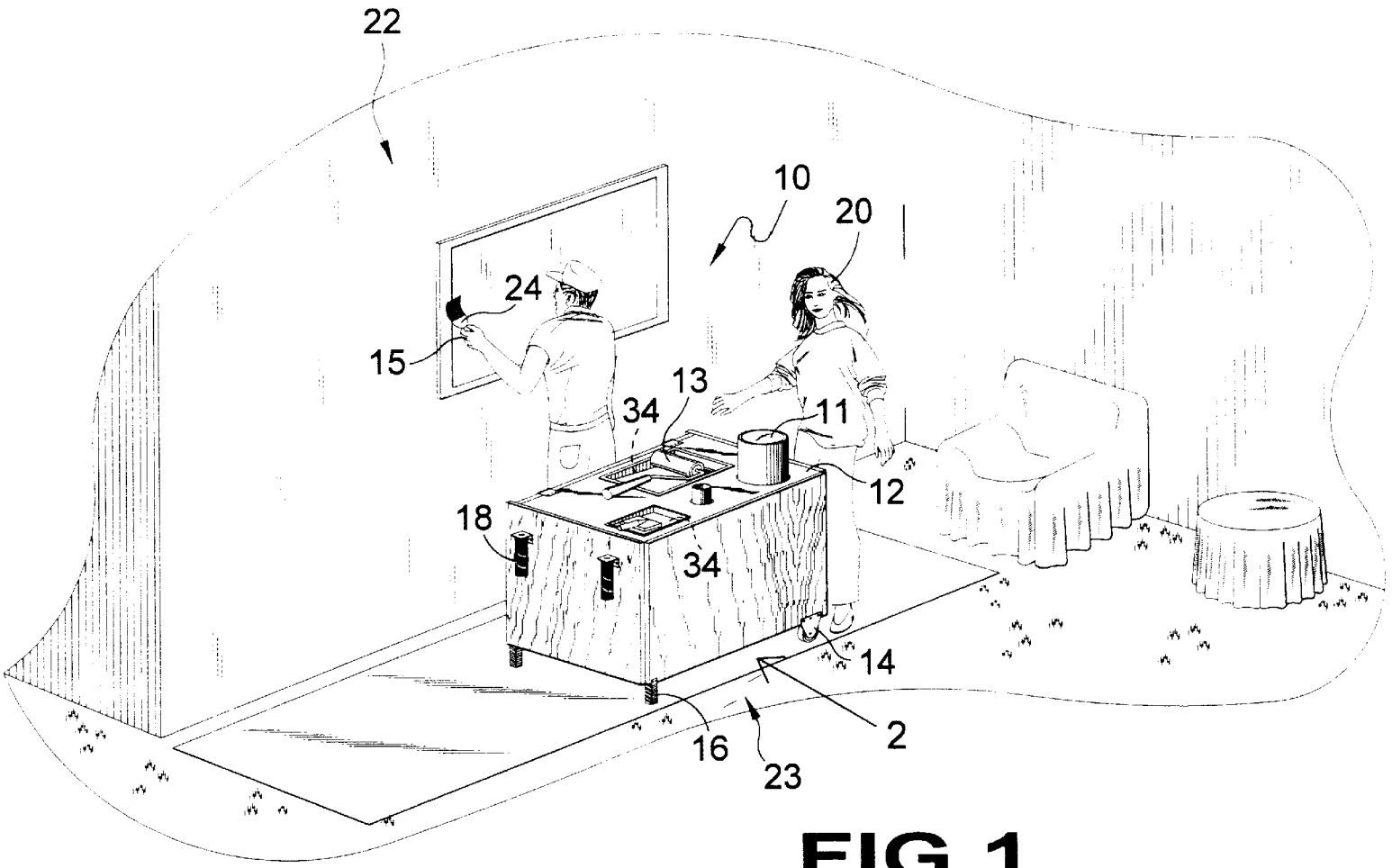
FIG. 1 is an illustrative view of the present invention in use whereby paint containers and applicators have been placed into appropriate receptacles formed into the top member of the painters workbench whereby said painting articles are located at a more convenient waist high position. Further said painters workbench has forwardly position wheels for selective mobility and rearwardly positioned leg members for maintaining said selective positioning. Also shown are hingedly attached handles, shown in a nonoperative position, which can be raised to their operative position providing means for selectively repositioning said workbench.

With regard to reference numerals used, the following numbering is used throughout the drawings.

10 present invention
11 container
12 top member
13 paint applicator
14 wheels
15 hand of user
16 legs
17 direction arrow
18 handles
20 user
22 wall
23 floor
24 paint brush
26 means for attachment of wheel
28 side member
30 means for attachment of leg
32 hinges
33 top recess
34 receptacles
36 side member
38 side member
40 side member
42 interior hinge
43 offset hinge
44 stop block
46 top edge
48 hinge pin
50 screw
52 plate
54 means for attaching

DESCRIPTION OF THE PREFERRED EMBODIMENT(S)

Turning now descriptively to the drawings, in which similar reference characters denote similar elements throughout the several views, FIGS. 1 through 11 illustrate the present invention being a mobile workstation for a painter.

Turning to FIG. 1, therein is shown an illustrative view of the present invention 10 in use whereby paint containers 11 and applicators 13 have been placed into appropriate receptacles or depressions 34 formed into the flat top member 12 of the painters workbench 10 whereby the painting articles arc located at a more convenient waist high position of user 20. The painters workbench 10 has forwardly positioned a pair of wheels 14 contacting floor 23 for selective mobility and rear positioned a pair of leg members 16 for maintaining the selective positioning. Also shown are a pair of hingedly attached handles 18, shown in a non-operative lower position, which can be raised to their operative position providing means for selectively repositioning the workbench 10. Also shown are users 20 in a walled enclosure 22 with a paint brush 24 in use in the hand 15 of the user 20.

Figure 2:
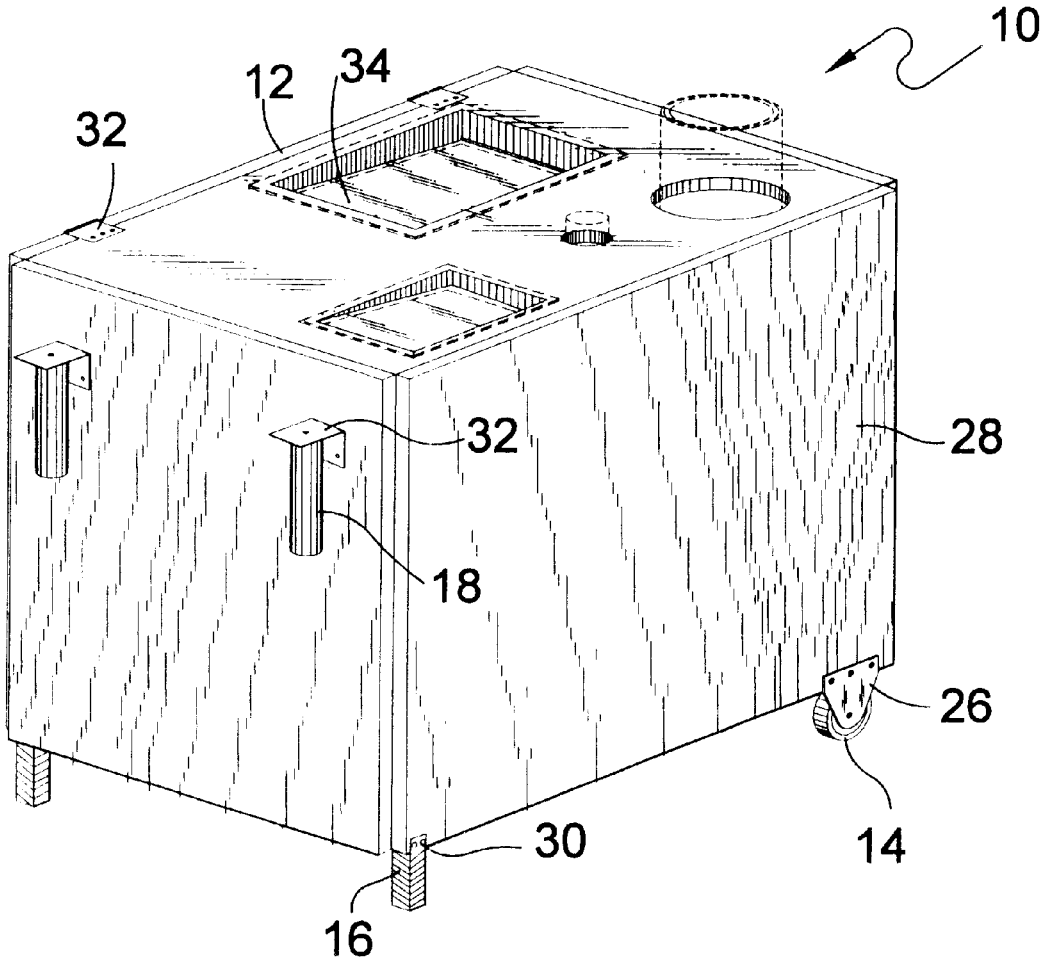
FIG. 2 is a perspective view, taken from FIG. 1 as indicated, of the present invention. Shown is the painters workbench in the unfolded operative configuration having front wheels fixedly attached to a side member providing means for selective mobility of the painters workbench and rear legs fixedly attached to a side member providing means for stationary stability. Also shown are hingedly attached handles, shown in a nonoperative position, and having been raised to their operative position providing means for raising and steering said painters workbench to a predetermined selective position. Also shown is a hingedly attached top member having a plurality of formed receptacles being of varying size, depth and pitch to accommodate differing paint containers and applicators.

Turning to FIG. 2, therein is shown a perspective view, taken from FIG. 1 as indicated, of the present invention 10. Shown is the painters workbench 10 in the unfolded operative configuration having front wheels 14 fixedly attached by means 26 to a lower edge of work station side member 28 providing means for selective mobility of the painters workbench 10 and rear legs 16 fixedly attached by means 30 to a lower edge of side member 28 providing means for stationary stability. Also shown are a pair of hingedly 32 attached handles 18, shown in a non-operative down position. When raised to their operative position handles 18 provide means for raising and steering the painters workbench 10 to a predetermined selective position. Also shown is a hingedly 32 attached top member 12 having a plurality of formed receptacles 34 therein being of varying size, depth and pitch to accommodate differing size and shape paint containers and applicators.

Figure 3:
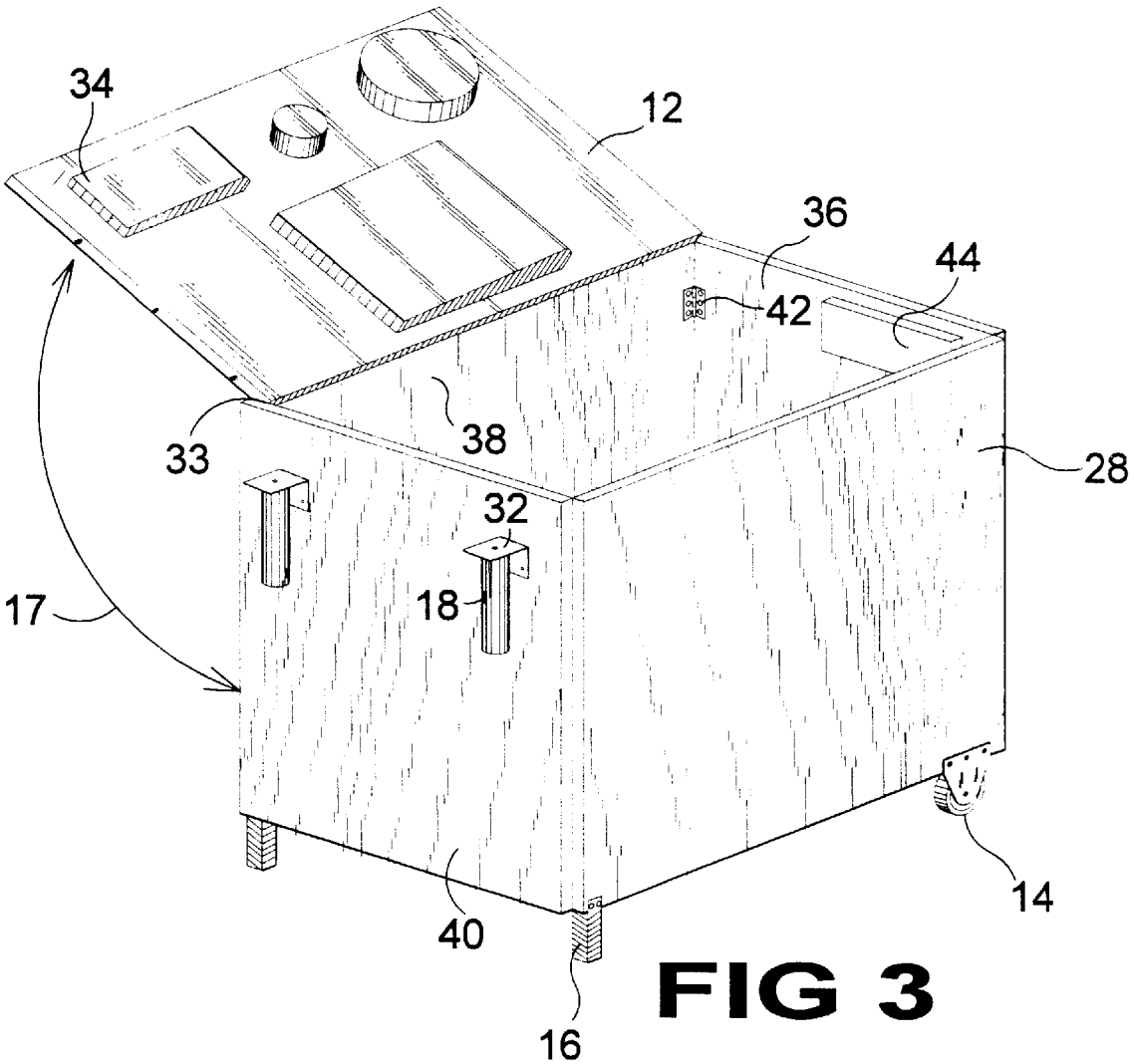
FIG. 3 is a perspective view of the present invention. Shown is the painters workbench comprised of four sides having interior hinges providing means for inwardly collapsing said painters workbench to a nonoperative folded position and for holding the side members together in an operative position. The top member being hingedly attached to a side member is pivoted from a nonoperative storage position to an operative position being recessed within the side members and positioned on a number of stop blocks. Also shown are wheels providing means for selective mobility and rear legs providing means for stationary stability. Also shown are hingedly attached handles which can be raised to their operative position providing means for raising and steering said painters workbench to a predetermined selective position. Also shown is a bottom view of the top member showing the underside of a number of receptacles being of varying size, depth and pitch to accommodate differing paint containers and applicators.

Turning to FIG. 3, therein is shown a perspective view of the present invention 10. Shown is the painters workbench 10 comprised of four sides 28, 36, 38 and 40 being generally rectangular shaped having interior hinges 42 providing means for inwardly collapsing the painters workbench 10 to a non-operative folded position and for holding the side members 28, 36, 38, 40 together in an operative position. The top member 12 being hingedly attached to a side member 38 is being pivoted as shown by arrow 17 from a nonoperative down storage position to an operative raised position being recessed 33 within the side members 36, 40 and positioned on a plurality of stop blocks 44. Also shown are wheels 14 providing means for selective mobility and rear legs 16 providing means for stationary stability. Also shown are hingedly 32 attached handles 18 which can be raised to their operative position providing means for raising and steering said painters workbench 10 to a predetermined selective position. Also shown is a bottom view of the top member 12 showing the underside of a number of receptacles 34 being of varying size, depth and pitch to accommodate differing paint containers and applicators.

Figure 4:
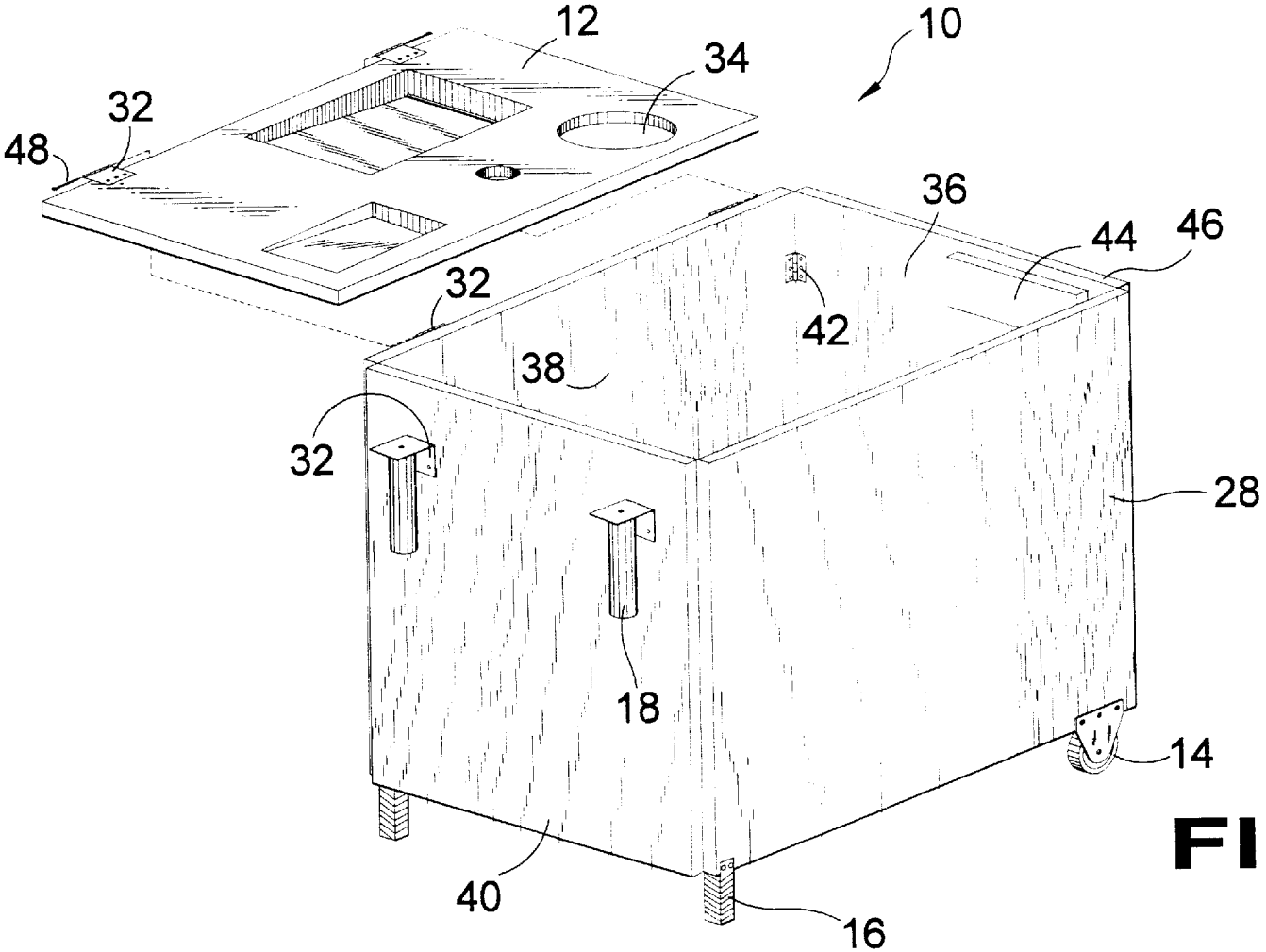
FIG. 4 is a perspective view of the present invention. Shown is the painters workbench being comprised of four sides having interior hinges providing means for inwardly collapsing said painters workbench to a non operative storage position and for holding the side members together in an operative position and having stop blocks located near the top edge providing stop and support blocks for the top member. The top member being hingedly attached to a side member has removable hinge pins whereby the top can be removed for easy cleaning purposes. Also shown are wheels providing means for selective mobility and rear legs providing means for stationary stability. Also shown are hingedly attached handles which when raised to their operative position provides means for raising and steering said painters workbench to a predetermined selective position. Also shown is a top perspective view of the top member showing a number of receptacles being of varying size, depth and pitch to accommodate differing paint containers and applicators.

Turning to FIG. 4, therein is shown a perspective view of the present invention 10. Shown is the painters workbench 10 being comprised of four sides 28, 36, 38, 40 having interior hinges 42 providing means for inwardly collapsing the painters workbench 10 to a non operative storage position and for holding the side members together in an operative position and having stop blocks 44 located near the top edge 46 of sides 28, 36, 40 providing stop and support blocks for the top member 12 when in an operative position. The top member 12 being hingedly 32 attached to a side member 38 has removable hinge pins 48 whereby the top 12 can be removed for easy cleaning purposes. Also shown are wheels 14 providing means for selective mobility and rear legs 16 providing means for stationary stability. Also shown are hingedly 32 attached handles 18 which when raised to their operative position provides means for raising and steering the painters workbench 10 to a predetermined selective position. Also shown is a top perspective view of the top member 12 showing a number of receptacles 34 being of varying size, depth and pitch to accommodate differing paint containers and applicators.

Figure 5:
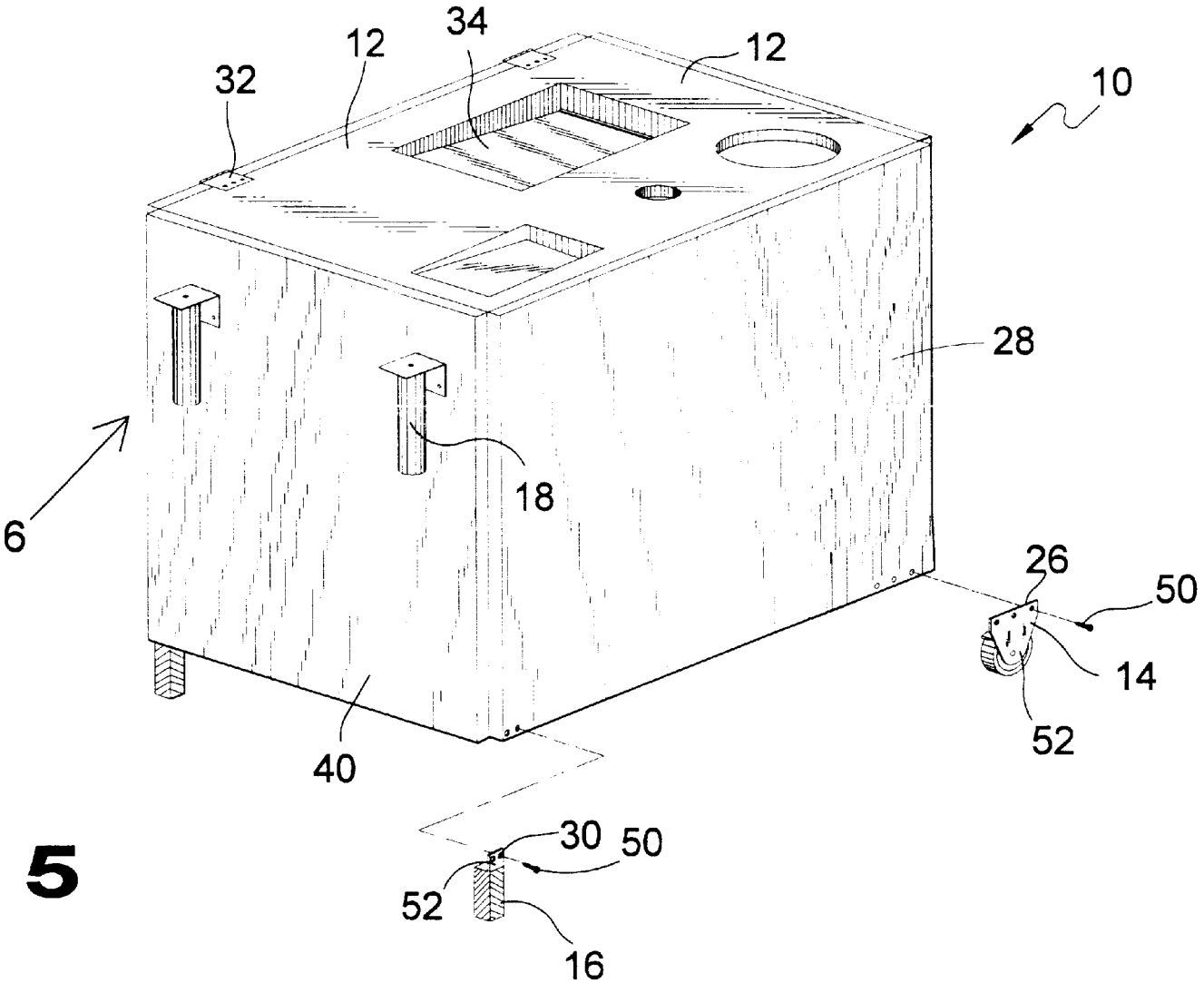
FIG. 5 is a perspective view of the present invention showing the sides and top member in the operative position and the handles in the nonoperative position. Also shown are means of attachment for a wheel member and means of attachment for a leg member.

Turning to FIG. 5, therein is shown a perspective view of the present invention 10 showing the sides 28, 40 and top member 12 in the operative position and the handles 18 in the non-operative position. Also shown are means of attachment 26 for a wheel member 14 and means of attachment 30 for a leg member 16 being, e.g., multiple screws or nails 50 and plate 52 as would be done by one skilled in the art in the standard manner. Other features previously disclosed are also shown.

Figure 6:
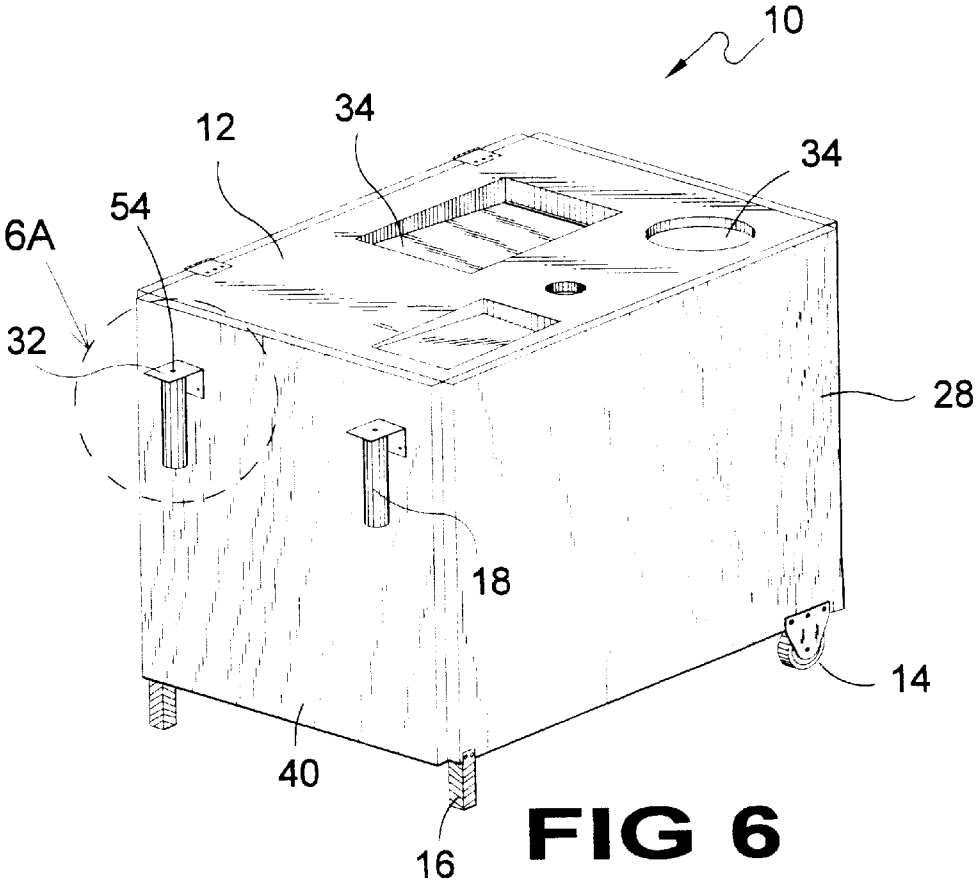
FIG. 6 is a perspective view of the present invention showing the painters workstation in the operative position whereupon a plurality of paining containers and applicators of varying size can be placed within the formed receptacles.

Turning to FIG. 6, therein is shown a perspective view of the present invention 10 showing the painters workstation in the operative position whereupon a plurality of painting containers and applicators of varying size can be placed within the formed multiple receptacles 34. Means for attaching 54 a hinge 32 to handle 18 is also shown. Other features previously disclosed are also shown.

Figure 6A:
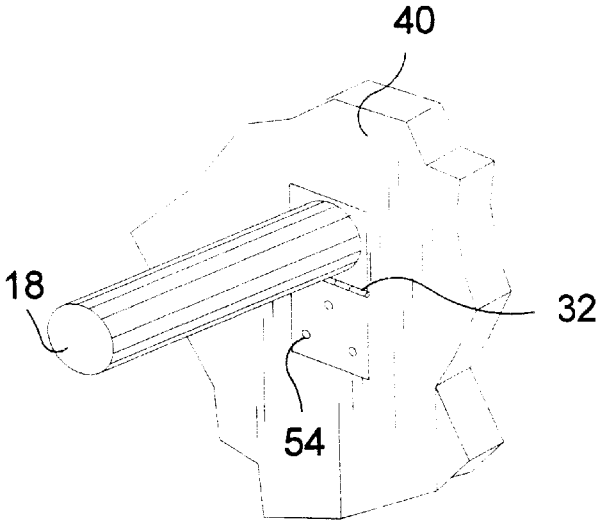
FIG. 6A is an exploded view of the hingedly attached handle raised to an operative position providing means for raising and steering the painters workbench to a predetermined selective position whereupon release the handles will pivotally return to a nonoperative position.

Turning to FIG. 6A, therein is shown an exploded view of the hingedly 32 attached handle 18 raised to an operative position on wall 40 providing means for raising and steering the painters workbench 10 to a predetermined selective position whereupon release of the handles 18 will pivotally return them by gravity to a non-operative position. Means for attaching 54 hinge 32 to wall 40 is also shown, e.g., being screws or nails.

Figure 7:
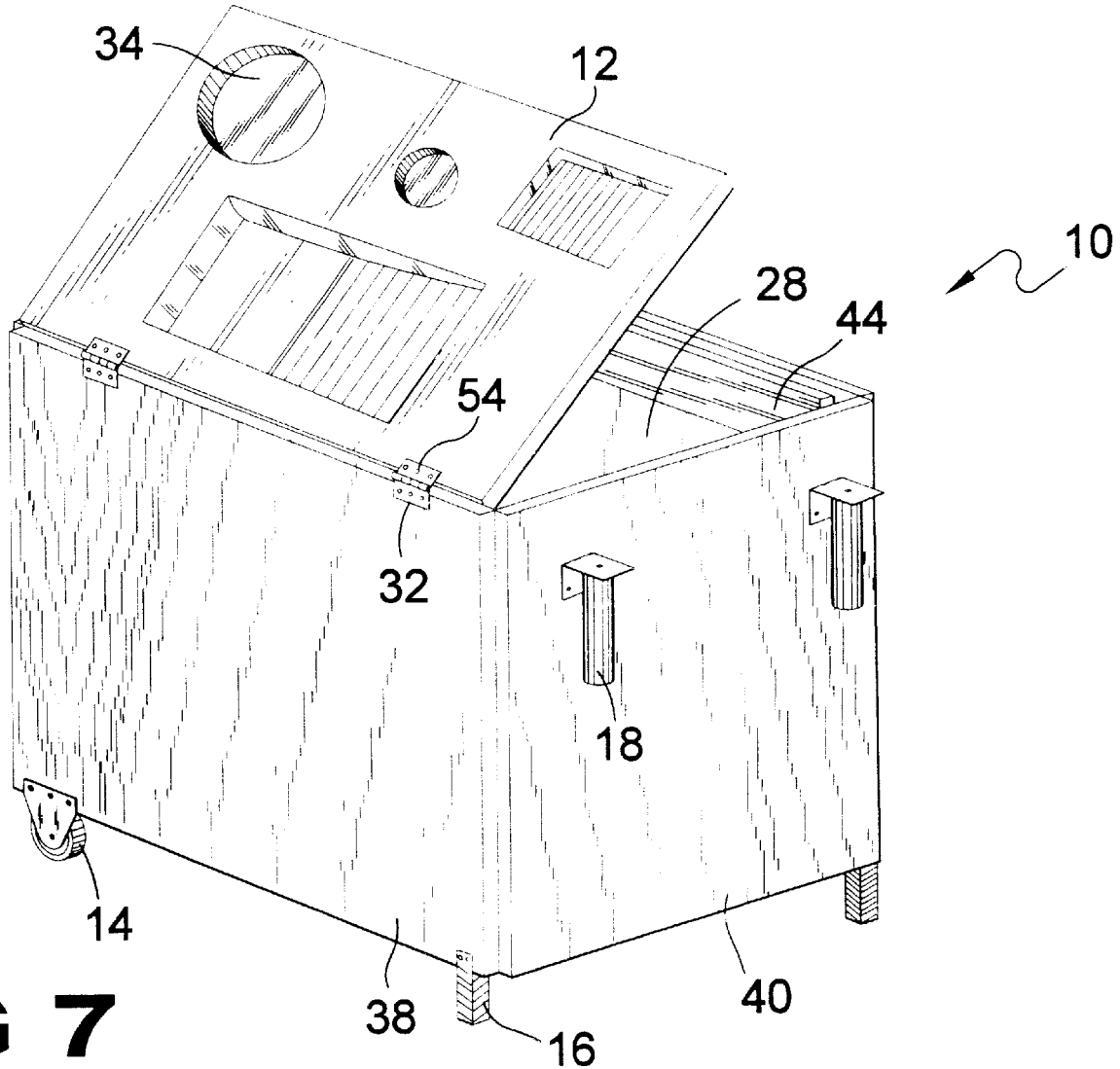
FIG. 7 is a perspective view of the present invention showing the painters workbench being folded whereupon the top member is pivotally raised from within the enclosure formed by three of the sides.

Turning to FIG. 7, therein is shown a perspective view of the present invention 10 showing the painters workbench 10 being folded whereupon the top member 12 is pivotally raised from within the enclosure formed by the sides. Stop block 44 is also shown and means for attaching 54 hinge 32 to top member 12. Other features previously disclosed are also shown.

Figure 8:
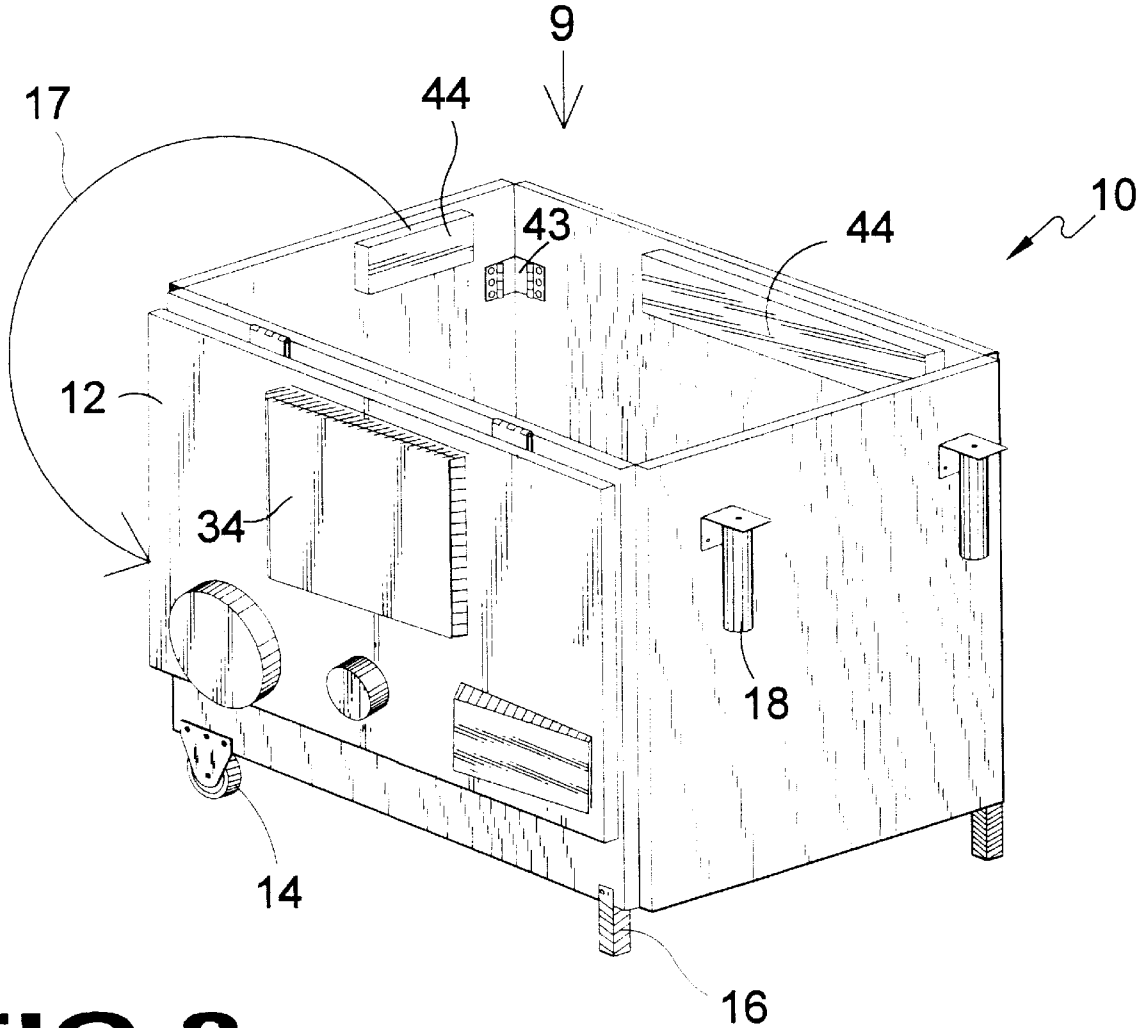
FIG. 8 is a perspective view of the present invention showing the painters workbench continuing to be folded as shown in FIG. 7, whereupon the top member has been pivotally moved to its nonoperative storage position. Also shown is one of the offset hinges allowing the sides to be inwardly collapsed.

Turning to FIG. 8, therein is shown a perspective view of the present invention 10 showing the painters workbench 10 continuing to be folded as shown in FIG. 7, whereupon the top member 12 has been pivotally moved as shown by arrow 17 to its nonoperative storage position. Also shown is one of a pair of the offset interior hinges 43 which together allowing the sides to be inwardly collapsed. Other features previously discussed are also shown.

Figure 9:
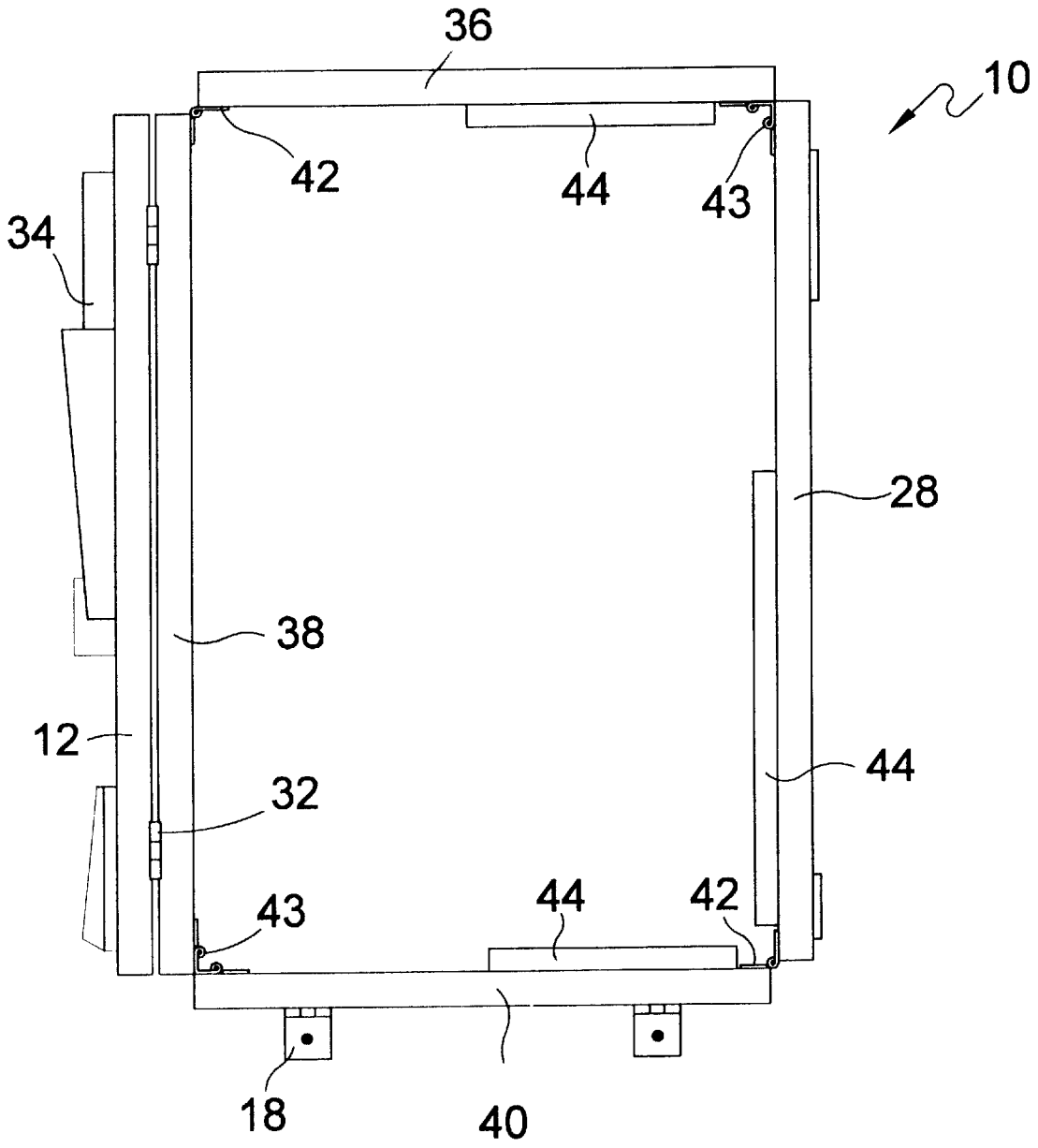
FIG. 9 is a top plan view, taken from FIG. 8 as indicated, of the present invention showing the painters workbench continuing to be folded as shown in FIG. 8, having the top member in the nonoperative storage position being hingedly attached to one of the sides. Also shown are the four sides having hinges placed within the vertices formed by the four sides. Two of the oppositely opposed vertices have offset hinges and the other two vertices have regular pin hinges.

Turning to FIG. 9, therein is shown a top plan view, taken from FIG. 8 as indicated, of the present invention 10 showing the painters workbench 10 continuing to be folded as shown in FIG. 8, having the top member 12 in the non-operative storage position being hingedly 32 attached to one of the sides 38. Also shown are the four sides 28, 36, 38, 40 having a pair of diagonally opposed hinges 42 placed within the corners formed by the four sides 28, 36, 38, 40. Two of the oppositely opposed corners have offset hinges 43 and the other two corners have standard pin hinges 42. Stop blocks 44 and receptacles 34 are also shown along with handles 18.

Figure 10:
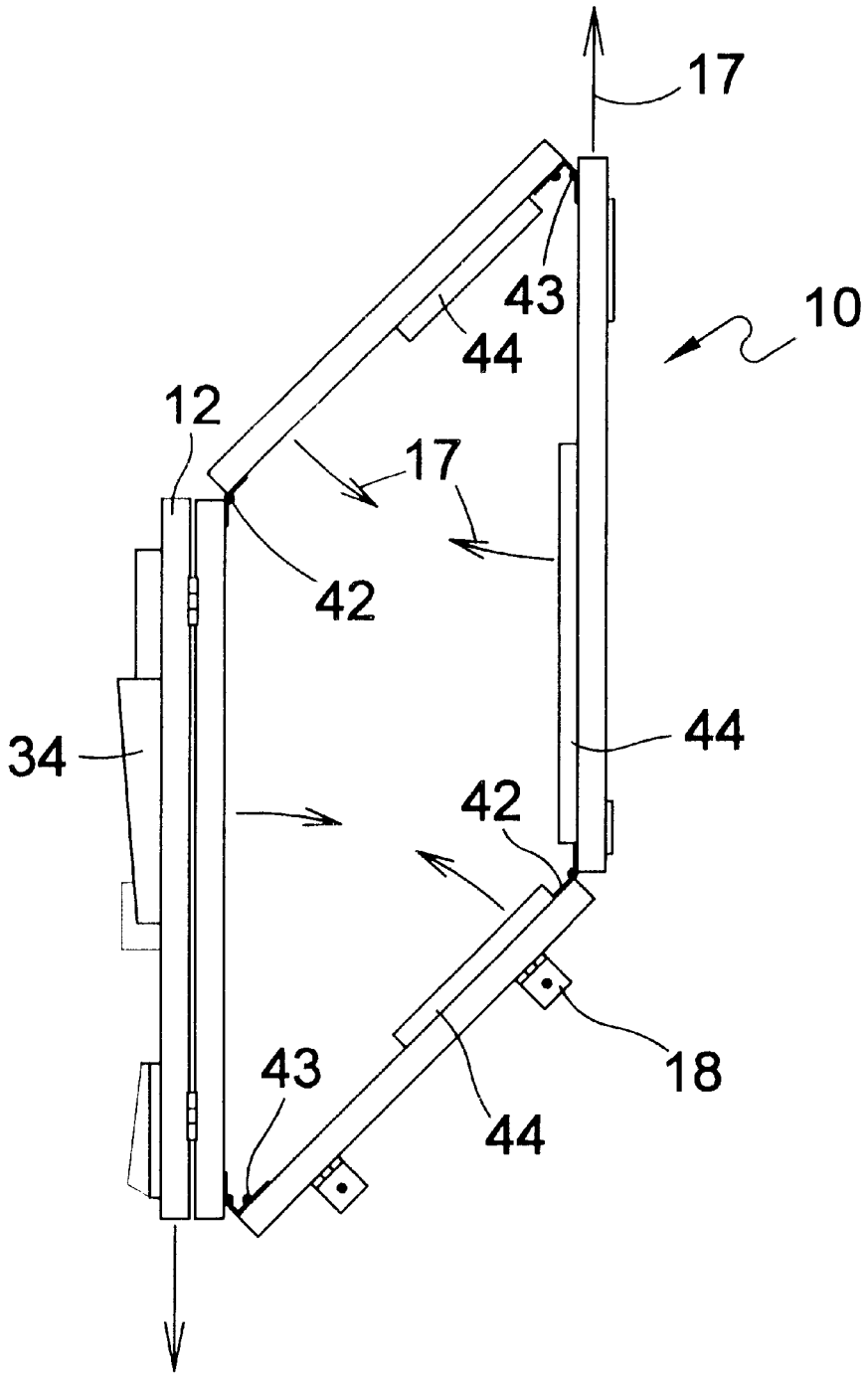
FIG. 10 is a top plan view of the present invention showing the painters workbench continuing to be folded as shown in FIG. 9. Two of the oppositely opposed vertices formed by the four sides have offset hinges whereby when an inward force is placed on the exterior side of the other pair of oppositely opposed hinges the painters workbench will collapse inwardly allowing room for the stop blocks.

Turning to FIG. 10, therein is shown a top plan view of the present invention 10 showing the painters workbench 10 continuing to be folded as shown in FIG. 9. Two of the diagonally oppositely opposed corners formed by the four sides have offset hinges 43 whereby when an inward force is placed on the exterior side of the other pair of oppositely opposed hinges 42 as shown by direction arrows 17 the painters workbench 10 will collapse inwardly allowing room for the stop blocks 44. Other features previously disclosed are also shown.

Figure 11:
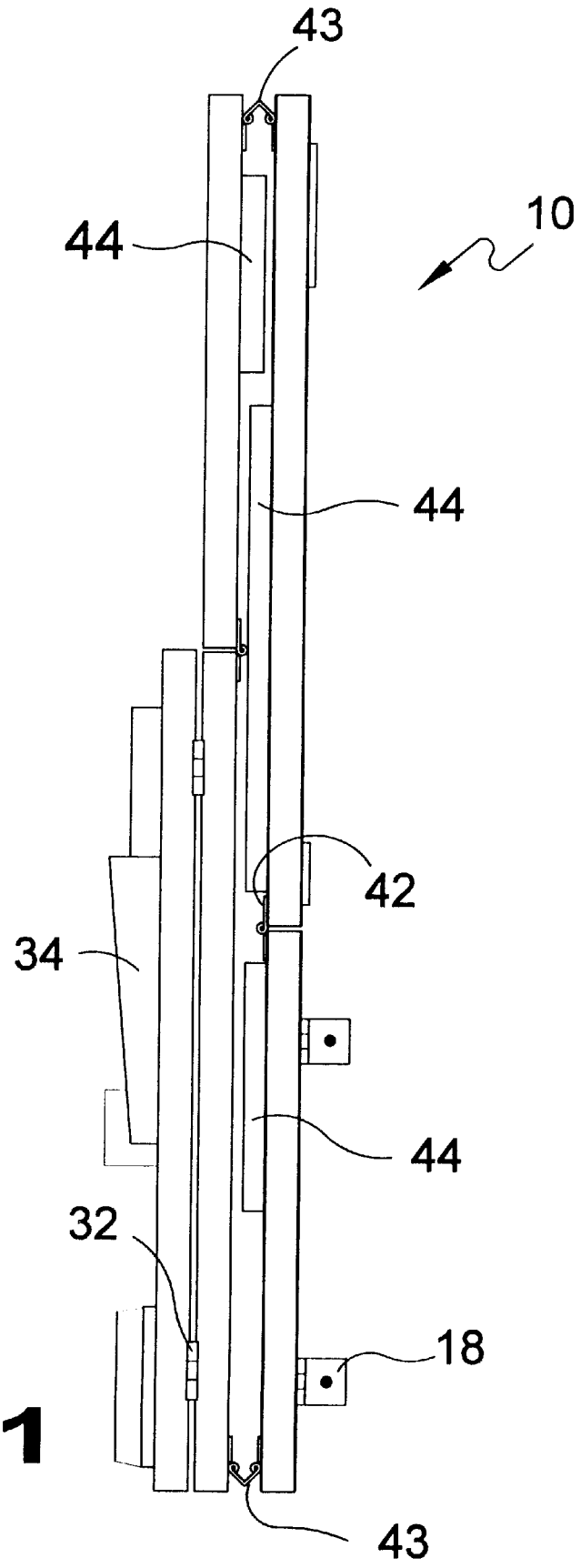
FIG. 11 is a top plan view of the present invention fully collapsed to its storage position and having wheels can be rolled to an appropriate storage location for future use.

Turning to FIG. 11, therein is shown a top plan view of the present invention 10 fully collapsed to its storage position and having wheels (not shown) which allow it to be rolled to an appropriate storage location for future use. Shown are the offset hinges, 43, standard hinges, 42, stop blocks 44 along with other features previously discussed.

What is claimed to be new and desired to be protected by Letters Patent is set forth in the claims:

1. Apparatus for a workstation for a painter, comprising:

a) an enclosure, said enclosure being generally rectangular shaped;

b) said enclosure defined by a top, a front, a back, and first and second ends;

c) a plurality of receptacles positioned on said top for receiving articles for painting;

d) a first means comprising hinges positioned on a top edge of said back for pivotally connecting said top to said back, said top being pivotal between a first horizontal position on the top of and closing said enclosure and a second vertical position against an outer surface of said back;

e) a second means for pivotally connecting said front and said back to said first and second ends comprising hinges in each interior corner of said enclosure allowing said enclosure to fold flat so that said back folds against the first end and said front folds against the second end with said top lying flat against an outside surface of said back;

f) first and second wheels; and, g) a first means for attaching said wheels to said enclosure comprising the first wheel being mounted on a bottom edge of said back adjacent said second end rotatable in a direction parallel with said back and the second wheel being mounted on a bottom edge of said front adjacent said second end rotatable in a direction parallel with said front thereby allowing said enclosure to be movable on said wheels both when said enclosure is unfolded and folded flat.

2. The apparatus of claim 1, further comprising a pair of handles attached to said enclosure, said handles providing means for grasping while moving said enclosure.

3. The apparatus of claim 2, further comprising a means for attaching said pair of handles to one end of said enclosure opposite said wheels.

4. The apparatus of claim 3, said means for attaching said pair of handles being pivotal.

5. The apparatus of claim 1, further comprising a pair of legs attached to said front and back of and adjacent said first end of said enclosure, said legs providing means for standing said enclosure thereon, said legs being fixedly attached.

6. The apparatus of claim 1, said hinges further comprising hinge pins, said top edge hinge pins being removable, whereby said top is removable.

* * * * *